US007293992B2

(12) United States Patent
Fredriksson

(10) Patent No.: US 7,293,992 B2
(45) Date of Patent: Nov. 13, 2007

(54) FIRING SIMULATOR

(75) Inventor: Arnold Fredriksson, Huskvarna (SE)

(73) Assignee: Saab AB, Linkoping (SE)

( * ) Notice: Subject to any disclaimer, the term of this patent is extended or adjusted under 35 U.S.C. 154(b) by 729 days.

(21) Appl. No.: 10/450,656

(22) PCT Filed: Dec. 13, 2001

(86) PCT No.: PCT/SE01/02763

§ 371 (c)(1),
(2), (4) Date: Nov. 19, 2003

(87) PCT Pub. No.: WO02/48633

PCT Pub. Date: Jun. 20, 2002

(65) Prior Publication Data

US 2004/0076927 A1 Apr. 22, 2004

(30) Foreign Application Priority Data

Dec. 15, 2000 (SE) ..... 0004700

(51) Int. Cl.
*F41G 3/26* (2006.01)

(52) U.S. Cl. ..... 434/21; 434/16; 434/19; 434/20

(58) Field of Classification Search ..... 434/19–23
See application file for complete search history.

(56) References Cited

U.S. PATENT DOCUMENTS

| | | | | |
|---|---|---|---|---|
| 4,195,422 A | | 4/1980 | Budmiger | |
| 4,689,016 A | | 8/1987 | Eichweber | |
| 4,695,256 A | | 9/1987 | Eichweber | |
| 4,801,201 A | | 1/1989 | Eichweber | |
| 4,975,565 A | | 12/1990 | Schmidt et al. | |
| 5,224,860 A | * | 7/1993 | Waldman et al. | 434/21 |
| 5,476,385 A | | 12/1995 | Parikh et al. | |
| 2002/0012898 A1 | * | 1/2002 | Shechter et al. | 434/21 |

FOREIGN PATENT DOCUMENTS

| | | | |
|---|---|---|---|
| CH | 612004 | | 6/1976 |
| DE | 3545831 | | 8/1986 |
| DE | 3904705 | | 8/1990 |
| EP | 0036099 | | 9/1981 |
| EP | 0055884 | | 7/1982 |
| GB | 2138926 | | 10/1984 |
| GB | 2159255 | | 11/1985 |
| WO | 00/53993 | | 9/2000 |
| WO | WO 00/53993 | * | 9/2000 |

* cited by examiner

*Primary Examiner*—Robert E. Pezzuto
*Assistant Examiner*—Cameron Saadat
(74) *Attorney, Agent, or Firm*—Bingham McCutchen LLP

(57) ABSTRACT

The present invention concerns a simulator arranged for the simulation of firing, which simulator is intended to be mounted on a weapon with aiming means. The simulator contains an emitter for a simulation bean and an emitting device for an alignment beam, which device contains a reticle arranged in a first focal plane of an optical system. The optical system is characterized in that it contains means for beam-splitting, where the optical system has a second focal plane, and where the emitter for the simulation beam is arranged in an optical path or extension thereof containing the second focal plane.

14 Claims, 4 Drawing Sheets

FIRING SIMULATOR

TECHNICAL AREA

The invention concerns simulators for simulating firing. The simulators are intended to be mounted on a weapon with a sight.

STATE OF THE ART

During simulated firing, the simulator emits a laser beam or electromagnetic radiation generated by means of a technology other than laser technology. The beam can be detected by one or more detectors mounted on one or more targets. The emitted beam, e.g. the laser beam, exhibits different intensity in different directions of radiation, which are known collectively as the "laser lobe". When the irradiance from the laser lobe at a given distance and in a given direction from the emitter exceeds the detection level of any detector on the target, the simulated effect of a weapon being fired at the target system located in said direction and at said distance is obtained.

WO00/53993 describes a device and a method for simulating the firing of a weapon. The simulated firing is accomplished using a simulator mounted on a weapon with a sight. The simulator is arranged so as to emit an electromagnetic simulation beam outward along a simulation axis. The simulator is also arranged so as to emit a visible alignment beam along an alignment axis that forms a fixed and known angle to the aforementioned simulation axis. The simulator contains adjusting means for collectively controlling the two aforementioned axes, the simulation axis and the alignment axis, so that they maintain their mutual fixed and known angtilar relation during the adjustment. The alignment beam is made visible in the weapon sight by means of a reflecting device, whereupon the alignment beam generates an aiming mark which, when it is observed in the weapon sight, indicates the misalignment between the simulation axis and the sight. This makes it possible for the marksman to align the sight with the simulation axis in a simple way, using the adjusting means.

Both the simulation beam and the alignment beam are generated by a common optical system, so that the simulator will function in a stable manner. A laser emitter is used to generate the simulation beam, which laser emitter is placed in the focal plane of the optical system. A reticle which, when illuminated, generates the alignment beam, is placed in the same focal plane as the laser. The laser and the reticle are also in fixed mechanical connection with one another.

This yields an extremely robust and stable system, but one disadvantage is that the reticle interferes with the simulation beam.

DESCRIPTION OF THE INVENTION

One purpose of the present invention is to provide a firing simulator that is a considerable improvement over the prior art, and which enables the simulation beam from the simulator to be given to an optimum intensity distribution.

This has been achieved by means of a simulator arranged to simulate firing, which simulator is intended to be mounted on a weapon with aiming means. The simulator contains an emitter to emit a simulation beam outward along a simulation axis, and an emitting device for emitting an alignment beam outward along an alignment axis, where the emitting device for the simulation beam includes a reticle arranged primarily in a first focal plane of an optical system. The simulator is characterized in that the optical system contains means for beam splitting, whereupon the optical system has a second focal plane. The emitter for the simulation beam is then arranged in an optical path or extension thereof that encompasses the second focal plane.

In one embodiment the transmittance and reflectance of the beam-splitting means are wavelength-dependent, and thus different for the simulation beam and the alignment beam.

With the emitter of the simulation beam physically separated from the emitter of the alignment beam, the components for generating the alignment beam do not interfere with the simulation beam. As a result, the simulation bean can be given an optimal intensity distribution (lobe shape).

In order to shape the beam lobe of the simulation beam so as to better accord with the probability that a detector at a target will detect a hit when live ammunition is used, beam-shaping means in one embodiment are arranged in the beam path of the simulation beam. The beam-shaping means are arranged so as to shape the beam in such a way that the beam lobe has an essentially constant diameter within a large range of distances from a given minimum distance from the simulator up to primarily a maximum range for the simulation beam. The given minimum distance is characteristically 5-10 meters from the emitter for the simulation beam.

The beam-shaping means may include optical components, but may also include other types of devices for modulating electromagnetic radiation.

Preferred embodiments may exhibit one or more of the features specified in the dependent claims.

FIGURE DESCRIPTION

Figure 5:
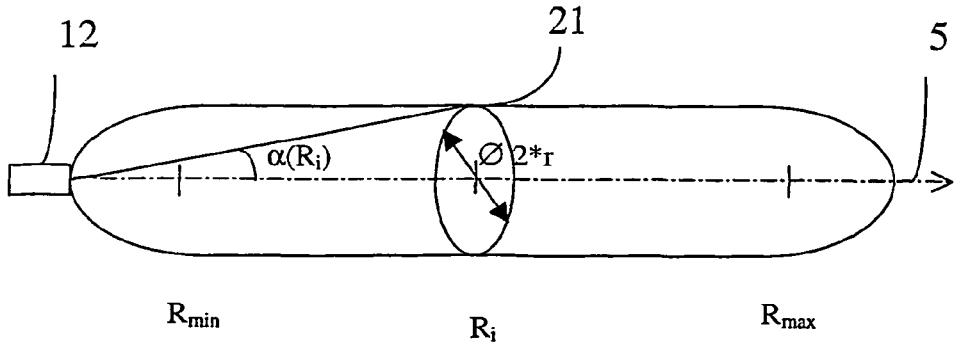

FIG. 5 schematically depicts the criteria for an ideal lobe shape for a simulation beam in accordance with one embodiment of the simulator.

Figure 6:
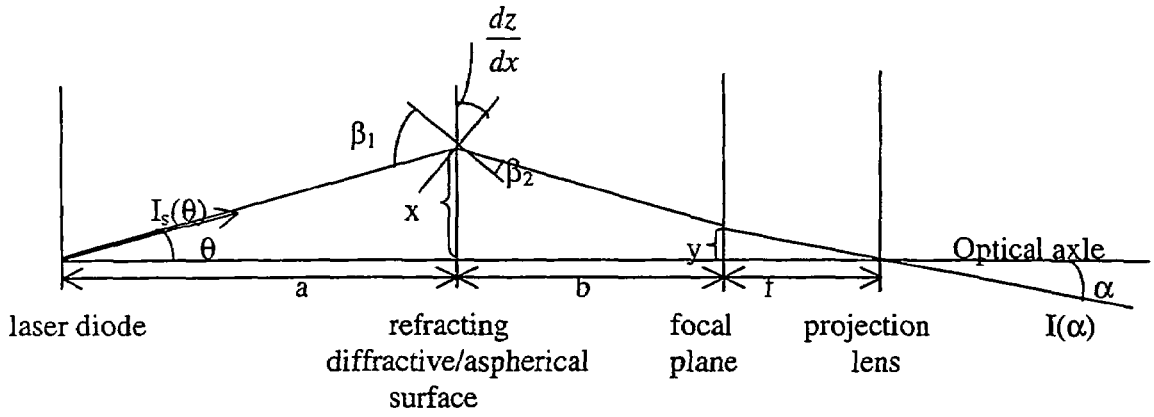

FIG. 6 illustrates an example of a method for calculating an essentially aspherical surface.

Figure 7:
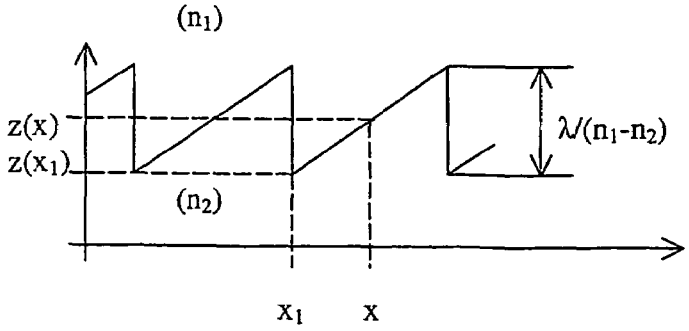

FIG. 7 shows an example of a conformation of a diffractive surface.

DESCRIPTION OF EMBODIMENTS

Figure 1:
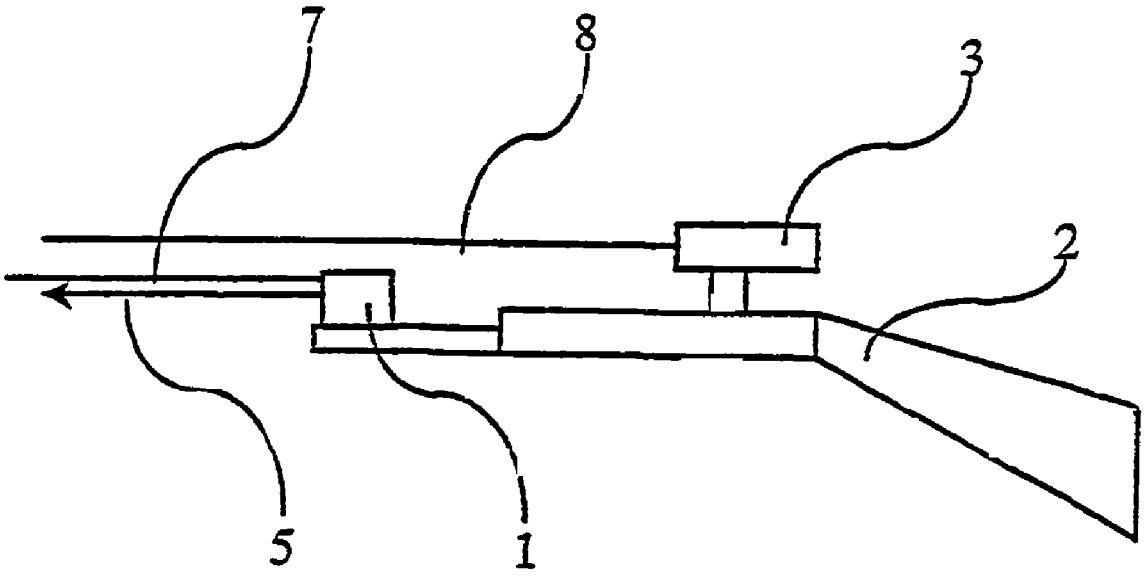
FIG. 1 illustrates a simulator on a weapon where the aiming axis, simulation axis and alignment axis are indicated.

In FIG. 1 a simulator 1 is mounted on a weapon 2 equipped with aiming means 3, preferably in the form of a sight. In the simulator 1 there is generated a simulation beam along a simulation axis 5. The simulator also emits an alignment beam along an alignment axis 7 that is parallel to the simulation axis 5. The aiming means 3 of the weapon define an aiming axis 8, and it is this aiming axis that defines the direction in which a round will leave the weapon 2 when live ammunition is fired.

Figure 2:
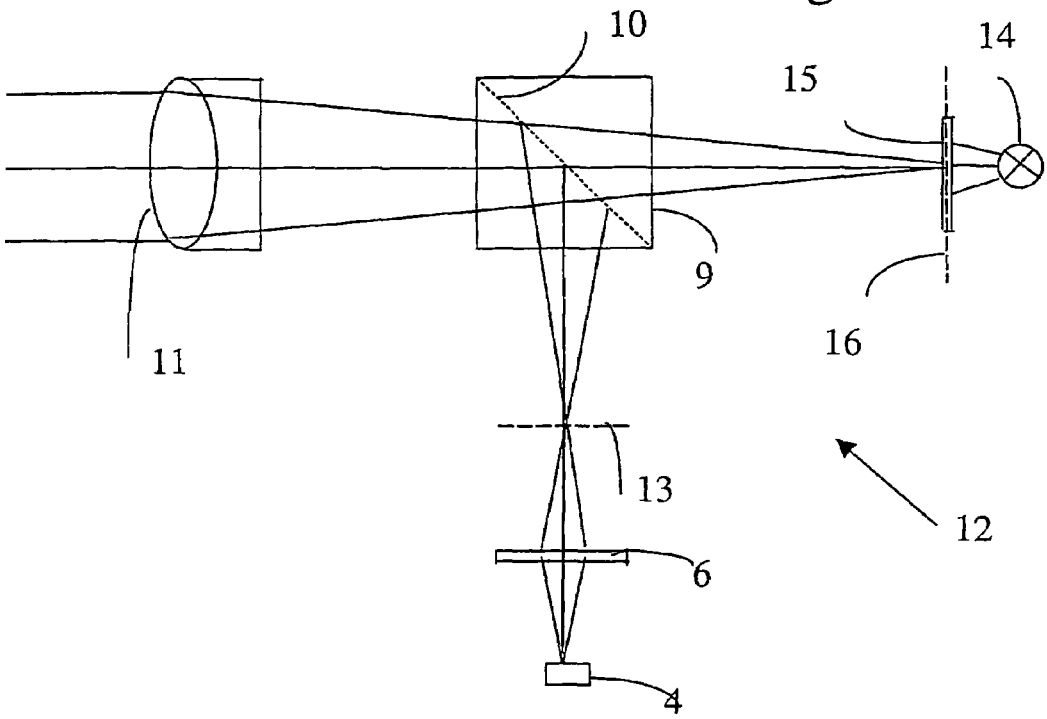
FIG. 2 shows an example of an optical system in the simulator.

In FIG. 2 the simulation beam is generated in an optical system 12 by a laser emitter 4 in the form of, e.g. a laser diode whose wavelength is, e.g. roughly 900 mm. It is also conceivable that the emitter could emit electromagnetic radiation using some technology other than laser technology. To improve the circular symmetry of the simulation beam from the laser diode, an optical fiber whose diameter can be roughly 50 μm is used in one embodiment (not shown), which fiber is arranged in the beam path after the laser diode in close relation to the laser diode so that the beam is reflected a number of times inside the fiber, thereby achieving a more symmetrical distribution of the aiming.

There is arranged in the beam path from the laser diode a beam-shaping optical component 6 with essentially positive refractive power containing at least one diffractive transmitting surface or aspherical refractive surface. There is arranged after the optical component 6 in the beam path a beam splitter 9 whose beam-splitting layer 10 is arranged so as to reflect a significant part of the simulation beam toward a projection lens 11. The optical component 6 is positioned in relation to the projection lens 11 and the laser diode 4 in such a way that the focal plane 13 of the projecting lens along this optical path with reflection in the beam-splitting layer 10 lies at the point where the simulation beam from the optical component 6 has a desired lobe shape, as will be described in detail below.

A source of visible light 14, such as a light-emitting diode, is arranged to generate the alignment beam. The light source 14 is arranged so that it illuminates a reticle 15 in the form of e.g. a glass plate with an engraved or imprinted pattern, cross-hairs or the like. The reticle is in turn arranged in a focal plane 16 of the projection lens in an optical path that passes through the beam-splitting layer 10 of the beam splitter 9. A portion of the alignment beam passes through the beam-splitting layer, while a second part is reflected away from the optical system 12. In the embodiment shown in FIG. 2 the laser diode 4, the light source 14 and the beam splitter 9 are placed in relation to one another in such a way that both the simulation beam and the alignment beam strike the beam-splitting layer 10, and in such a way that the reflected simulation beam and the alignment beam that passed through the beam-splitting layer pass as a composite beam toward the projection lens 11. After passing through the projection lens 11, the simulation beam and the alignment beam leave the simulator 1 along a common simulation and alignment axis, 5, 7.

The technology involved in designing a beam splitter with the foregoing properties is conventional to one skilled in the art. It is currently possible to design, at reasonable cost, a beam-splitting layer that reflects roughly 90% of the beam in a wavelength range in which the simulation beam exists while 10% passes through the layer and out from the optical system 12, and while the beam splitter simultaneously allows roughly 75% of the visible alignment beam to pass through. It should be added that it is not critical to the performance of the optical system 12 for an extremely high proportion of the beam to be passed to the projection lens. A somewhat lower portion can be compensated for by increasing the output power from the laser diode 4 and the light source 14.

In an alternative embodiment the placements of the focal planes 16, 18 are reversed so that the beam-splitting layer allows the simulation beam to pass in the direction toward the projection lens and reflects the alignment beam toward the projection lens.

Figure 3:
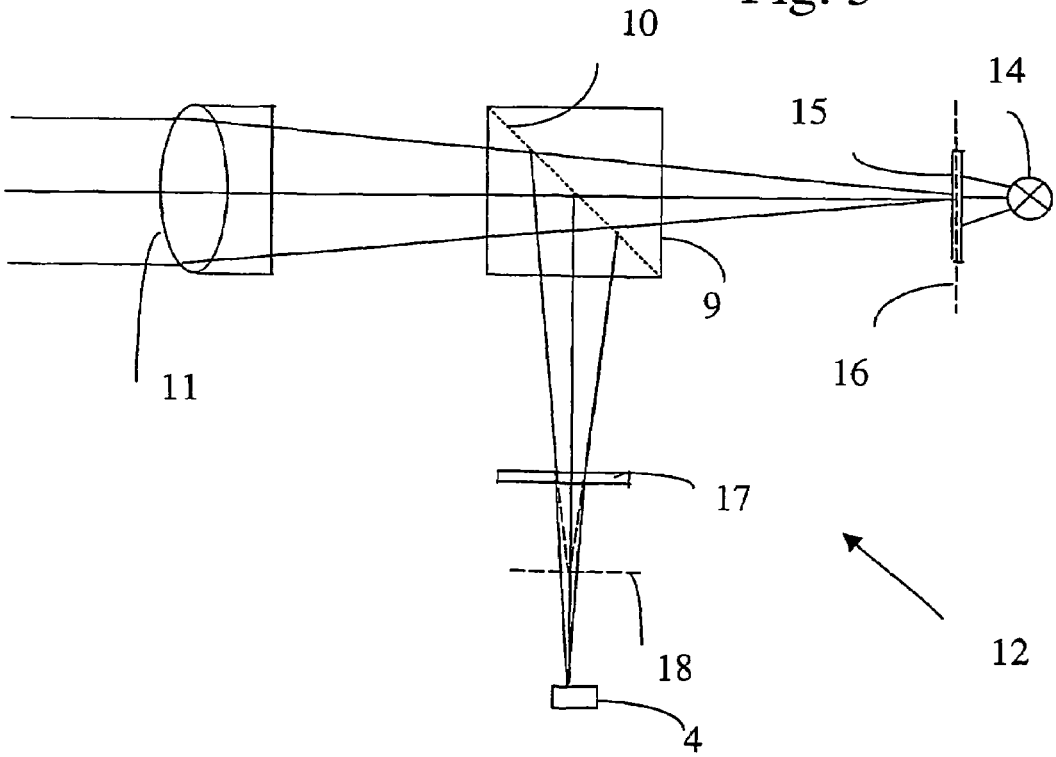
FIG. 3 shows an alternative example of an optical system in the simulator.

The simulation beam is generated by the laser diode in FIG. 3 as well. There is arranged in the beam path from the laser diode a beam-shaping optical component 17 with essentially negative refractive power containing at least one diffractive transmitting surface or aspherical refractive surface. After the negative optical component 17 there is arranged in the beam path a beam splitter 9 whose beam-splitting layer 10 is arranged in the same manner as described above so as to reflect a significant part of the simulation beam toward the projection lens 11. The negative optical component 17 is placed in relation to the projection lens 11 and the laser diode 4 in such a way that a virtual focal plan 18 in the extension of the optical path lies at the point where the simulation beam from the optical component should have a desired lobe shape, as will be described in detail below. This embodiment too includes the alignment-beam-generating light source 14 arranged so that it illuminates the reticle 15. The reticle is arranged in the focal plane 16 of the projection lens 11 in an optical path through the beam-splitting layer of the beam splitter. A first portion of the alignment beam passes through the beam-splitting layer and toward the projection lens 11, while a second part is reflected away from the optical system 12. In this embodiment the laser diode 4, the light source 14 and the beam splitter 9 are again placed in relation to one another in such a way that both the simulation beam and the alignment beam strike the beam-splitting layer, and in such a way that the reflected simulation bean and the alignment beam that passed through the beam-splitting layer pass toward the projection lens 11 as a composite beam. The function of this embodiment is thus identical with that of the embodiment depicted in FIG. 2. In one example the mechanical dimensions of the beam splitter in the embodiment shown in FIG. 3 are such that, with the reticle and the beam-shaping optical component 17 arranged at the beam splitter, by means of e.g. gluing, the necessary optical distance is achieved in the optical system. This yields an extremely robust design. For a more compact design, one or more further reflecting surfaces may be included.

In an alternative embodiment the placements of the focal planes 16, 18 are reversed so that the beam-splitting layer allows the simulation beam to pass in the direction toward the projection lens and reflects the alignment beam toward the projection lens.

Figure 4:
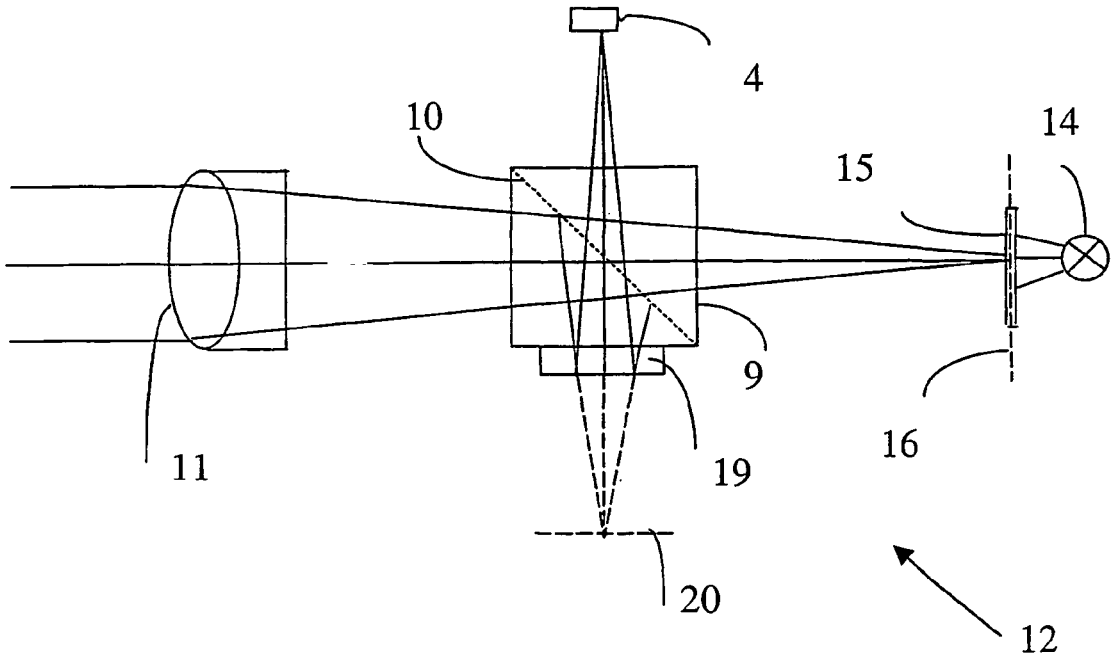
FIG. 4 shows yet another example of an alternative optical system in the simulator.

FIG. 4 includes the light source 14, the reticle 15 arranged in the focal plane 16 of the projection lens 11, and the beam splitter 9. The light source 14 generates the alignment beam, which is allowed to pass through the reticle 15, the beam splitter 9 and the projection lens 11 in the same manner as described above. The laser diode 4 for generating the simulation beam is arranged in relation to the other components in such a way that the simulation beam is allowed to pass once through the beam-splitting layer 10 before the beam reaches an essentially positive or negative optical component 19 in the form of at least one diffractive or aspherical reflecting surface. The simulation beam is reflected from this optical component 19 back to the beam splitter, where a portion of the simulation beam is reflected toward the projection lens as described above. Reference number 20 designates a virtual focal plan for the projection lens in an optical path with reflection in the beam splitter. The function of this embodiment is exactly the same as in those illustrated in connection with FIGS. 2 and 3. In an alternative embodiment the placements of the focal planes 16, 18 are reversed so that the beam-splitting layer allows the simulation beam to pass in the direction toward the projection lens and reflects the alignment beam toward the projection lens.

The optical component 6, 17, 19 in each described embodiment is designed so that the beam lobe of the simulation beam will, as the beam leaves the projection lens 11 in the simulator 1, have an essentially circular cross-section 21 along its entire length. Further, the diameter shall be substantially constant along the entire length from a distance $R_{min}$ located roughly 5 to 10 meters from the simulator out to a maximum range $R_{max}$ which, for various applications, is usually between 300 m to 1200 m from the simulator, as shown in FIG. 5. The constant diameter is characteristically 0.3 m to 1.0 m and preferably about 0.5 m in an application where the target is an infantry soldier.

The intensity of this ideal lobe is thus defined by the following equation, where the distance $R_i$ is a distance from the simulator along the simulation axis 5, and $R_{min}<R_i<R_{max}$:

$I(R_i)=E_\tau*R^2_i/T(R_i)$ for $\alpha(R_i)=r/Ri$, yielding a function $I(\alpha)$, where $E_\tau$ is the detection threshold of the target, $T(R_i)$ is the atmospheric transmittance for a chosen weather situation, $\alpha(R_i)$ is the radial angle from the symmetry axis of the beam lobe (=the simulation axis 5) for which the intensity is $I(R_i)$, and r is one-half the diameter of the target surface, taking into account the placement of one or more simulation-beam-detecting detectors on the target.

A power distribution $E(\alpha)$ is then obtained as $E(\alpha)=I(\alpha)/(\tau\times f^2)$ if the beam splitter transmits the beam from this focal plane toward the projection lens, or as $E(\alpha)=I(\alpha)/(\rho*f^2)$ if the beam splitter reflects the beam from the focal plane, where f is the effective focal length of the optical system and $\tau$ and $\rho$ are the product of the transmittance of the optical system and the transmittance and reflectance of the beam splitter, respectively.

The radiation power P that passes the second focal plan via a subsurface with a radius y centered about the optical axis is the integral from 0 to y/f of $(E(\alpha)*2*\pi*\alpha*d\alpha)$.

The radiation power $P_s$ that passes the diffractive/aspherical surface via a subsurface with the radius x centered about the optical axis is the integral from 0 to x/a of $(I_s(\Theta)*2*\pi*\Theta*d\Theta)$, where $I_s(\Theta)$ is the radiation intensity from the laser diode in a direction that forms the angle $\Theta$ with the optical axis, and were a is the distance between the laser diode and the diffractive/aspherical surface. The beam from the laser diode or from the optical fiber is assumed to be approximately rotationally symmetric within a limited angular range near the optical axis.

By setting $P_s$=P and letting x rise from 0 (=the optical axis), the slope dz/dx for an aspherical surface between two media with different refractive indices $n_1$ and $n_2$ can be calculated for each point at the distance x from the optical axis by applying the law of refraction, $n_1*\sin(\beta_1)=n_2*\sin(\beta_2)$ and the formula $y=\Theta*(a+b)-b*(\beta_1-\beta_2)$. The height of the surface measured parallel to the optical axis z(x) is obtained by integrating the slope; see FIG. 6.

For a diffractive surface between two media with refractive indices $n_1$ and $n_2$ the phase function $\phi(x)=z(x)*2*\pi*(n_1-n_2)/\lambda$ is obtained, where $\lambda$ is the wavelength of the beam.

If the diffractive surface is given a form as per FIG. 7 (kinoform), then all orders except for first order diffraction will be suppressed.

We have now described a number of types of optical components that can be used to create a desired lobe shape, and how the optical components must generally be conformed to obtain the desired simulation beam lobe properties. In an alternative embodiment the optical component is replaced with a beam-reshaping device of an alternative type arranged so as to modulate the simulation beam to produce the desired beam lobe shape.

It is possible to incorporate diffractive or aspherical refractive optical components in, e.g. a firing simulator such as is described in WO00/53993 to shape the simulation beam so that it has a lobe whose diameter is essentially constant along a section of the simulation axis from a given distance $R_{min}$ from the simulator out to a maximum range $R_{max}$.

The invention claimed is:

1. A simulator arranged for simulating firing and intended to be mounted on a weapon with aiming means, which simulator includes an emitter for a simulation beam and an emitting device for an alignment beam, which device includes a reticle arranged in a first focal plane of an optical system, and the optical system contains means for beam splitting characterized in, that said simulation beam and said alignment beam have an origin from at least two separate sources, wherein the simulation beam source is associated with a second focal plane of said optical system.

2. A simulator according to claim 1, characterized in that the emitter for the simulation beam is arranged in an optical path or extension thereof encompassing the second focal plane.

3. A simulator according to claim 2, characterized in that the transmittance and reflectance of the beam-splitting means are wavelength-dependent.

4. A simulator according to claim 1, characterized in that the simulation beam is electromagnetic, and in that the emitter of the simulation beam is a laser diode.

5. A simulator according to claim 1, characterized in that an optical fiber is arranged in close relation to the emitter for the simulation beam in the beam path after the emitter.

6. A simulator according to claim 1, characteiized in that the means are arranged in the beam path of the simulation beam to shape the beam so that its beam lobe exhibits a predetermined shape within a large range of distances from a given minimum distance $R_{min}$ from the simulator principally out to a maximum range $R_{max}$ for the simulation beam.

7. A simulator according to claim 6, characterized in that the beam lobe has an essentially constant diameter within the range of distances.

8. A simulator according to claim 6, characterized in that the beam-shaping means contain an optical component.

9. A simulator according to claim 8, characterized in that the optical component contains at least one diffractive transmitting surface.

10. A simulator according to claim 8, characterized in that the optical component contains at least one diffractive reflecting surface.

11. A simulator according to claim 8, characterized in that the optical component contains at least one aspherical refractive surface.

12. A simulator according to claim 8, characterized in that the optical component contains at least one aspherical reflective surface.

13. A simulator according to claim 8, characterized in that the conformation of the optical component is chosen based on geometrical optics calculations.

14. A simulator according to claim 9, characterized in that the, conformation of the optical component is chosen based on Fourier transform calculations.

* * * * *